US008004195B2

(12) United States Patent
Shido

(10) Patent No.: US 8,004,195 B2
(45) Date of Patent: Aug. 23, 2011

(54) DISCHARGE BULB FOR VEHICLE

(75) Inventor: Masaya Shido, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 775 days.

(21) Appl. No.: 12/044,134

(22) Filed: Mar. 7, 2008

(65) Prior Publication Data

US 2008/0231194 A1 Sep. 25, 2008

(30) Foreign Application Priority Data

Mar. 23, 2007 (JP) ..... 2007-076692

(51) Int. Cl.
*H01J 17/16* (2006.01)

(52) U.S. Cl. ..... 313/634; 313/631

(58) Field of Classification Search ..... 313/17, 313/631, 634

See application file for complete search history.

(56) References Cited

U.S. PATENT DOCUMENTS

| | | | | |
|---|---|---|---|---|
| 2,367,579 | A * | 1/1945 | Henry | 313/573 |
| 5,144,201 | A * | 9/1992 | Graham et al. | 313/634 |
| 5,359,255 | A * | 10/1994 | Kawai et al. | 313/17 |
| 2003/0062839 | A1 * | 4/2003 | Takagaki et al. | 313/634 |
| 2005/0007020 | A1 * | 1/2005 | Tsuda et al. | 313/634 |
| 2006/0273723 | A1 * | 12/2006 | Stockwald et al. | 313/631 |

FOREIGN PATENT DOCUMENTS

JP 2004-362978 A 12/2004

* cited by examiner

*Primary Examiner* — Nimeshkumar D Patel
*Assistant Examiner* — Mary Ellen Bowman
(74) *Attorney, Agent, or Firm* — Sughrue Mion, PLLC

(57) ABSTRACT

A discharge bulb and an arc tube are provided. The discharge bulb includes an arc tube main body having a discharge arc chamber, in which two discharge electrodes are disposed to oppose to each other; a tube portion disposed at each end portion of the arc tube main body, each of the tube portions being in communication with the discharge arc chamber and holding one of the discharge electrodes, wherein a wall for forming the discharge arc chamber has a taper portion whose diameter is reduced gradually from a cylinder portion of the arc tube main body in a center area to the tube portion of the arc tube main body, and an inner diameter Di of the cylinder portion is about 1.0 mm to about 2.5 mm, and a projection length Le of the discharge electrode into the discharge arc chamber is about 1.5 mm to about 2.5 mm.

15 Claims, 10 Drawing Sheets

FIG. 6

(UNIT: mm OMITTED)

| TEST SPECIMEN | | 1 | 2 | 3 | 4 | 5 | 6 | 7 | 8 | 9 | 10 | 11 | 12 | 13 |
|---|---|---|---|---|---|---|---|---|---|---|---|---|---|---|
| ITEM | | RELATED-ART | TEST SPECIMEN WITH INNER DIAMETER DIFFERENCE | | | | TEST SPECIMEN WITH ELECTRODE PROJECTION/ INNER DIAMETER DIFFERENCE | | | | | TEST SPECIMEN WITH ELECTRODE LENGTH DIFFERENCE | | |
| PARAMETER | Di | 2.0 | 0.8 | 1.0 | 2.5 | 3.0 | 2.0 | 2.5 | 3.0 | 2.5 | 2.5 | 2.0 | 2.0 | 2.0 |
| | Le | 0.5 | 0.5 | 0.5 | 0.5 | 0.5 | 1.5 | 1.5 | 1.5 | 2.5 | 2.8 | 1.5 | 1.5 | 1.5 |
| | Li | 2.5 | 2.5 | 2.5 | 2.5 | 2.5 | 1.5 | 1.5 | 1.5 | 0.5 | 0.2 | 0.0 | 0.5 | 1.7 |
| | Le + Li | 3.0 | 3.0 | 3.0 | 3.0 | 3.0 | 3.0 | 3.0 | 3.0 | 3.0 | 3.0 | 1.5 | 2.0 | 3.2 |
| | TOTAL LENGTH OF DISCHARGE ARC CHAMBER | 5.0 | 5.0 | 5.0 | 5.0 | 5.0 | 7.0 | 7.0 | 7.0 | 9.0 | 9.6 | 7.0 | 7.0 | 7.0 |
| RESULT (CHARACTERISTIC) | LUMINOUS EFFICIENCY | × | × | × | × | ○ | ○ | ○ | ○ | ○ | × | △ | ○ | △ |
| | ARC BENDING | ○ 0.4 | ○ 0.0 | ○ 0.0 | ○ 0.5 | × 0.8 | ○ 0.4 | ○ 0.5 | × 0.8 | ○ 0.5 | ○ 0.5 | ○ 0.5 | ○ 0.5 | ○ 0.5 |
| | IODIDE POSITION | × C | × C | × C | × C | × A | ○ B | ○ B | × A | ○ B | ○ B | ○ B | ○ B | ○ B |
| | CONVERSION EFFICIENCY INTO AVAILABLE LUMINOUS FLUX | ○ | ○ | ○ | ○ | × | ○ | ○ | × | ○ | ○ | ○ | ○ | ○ |
| | DURABILITY | × | × | ○ | ○ | ○ | ○ | ○ | ○ | ○ | ○ | ○ | ○ | ○ |
| | TOTAL EVALUATION | × | × | × | × | × | ○ | ○ | × | ○ | × | × | ○ | × |

IODIDE POSITION A: LOWER PORTION OF CENTER PORTION OF ARC TUBE
B: LOWER PORTION (TAPER PORTION) OF END PORTION OF ARC TUBE
C: PERIPHERY OF ELECTRODE (INLET PORTION OF PORE)

DISCHARGE BULB FOR VEHICLE

This application is based on and claims priority from Japanese Patent Application No. 2007-076692, filed on Mar. 23, 2007, the entire contents of which are hereby incorporated by reference.

BACKGROUND

1. Technical Field

Apparatuses and devices consistent with the present invention relate to light sources for vehicles and the like, and more particularly, to discharge bulbs for vehicles.

2. Description of the Related Art

As a light source of a vehicle headlamp, a discharge bulb equipped with a glass arc tube main body has been used. However, such a discharge bulb has a number of disadvantages. First, a metal halogenide sealed in the glass tube causes corrosion of the glass tube. Second, a proper light distribution cannot be obtained due to the occurrence of a blackening or devitrification phenomenon. Lastly, the life of the discharge bulb equipped with a glass arc tube is not so long. Moreover, a discharge arc chamber of the glass arc tube main body is formed of a glass sphere. Therefore, a sealed material such as the metal halogenide, which is supersaturated, accumulates in a liquid state on the bottom portion in the glass sphere, and a desired light distribution characteristic or a white light distribution color cannot be obtained.

Japanese Patent Application Publication No. JP-A-2004-362978 describes a related art discharge bulb. This related art discharge bulb is shown in FIG. 10. The related art discharge bulb is equipped with a ceramic arc tube main body having a discharge arc chamber in which a pair of discharge electrodes are provided to oppose to each other and a luminous material as well as a starting rare gas is sealed within the discharge arc chamber. More particularly, the arc tube main body has such a structure that both end portions of a circular cylindrical ceramic tube 200, having a thin tube portion to which a pore 201 being in communication with the discharge arc chamber is provided, are sealed by joining a molybdenum pipe 212 to the pores 201 at both end portions of the circular cylindrical ceramic tube 200. Then, a rear end portion of an electrode rod 214, which is inserted into the molybdenum pipe 212 such that a top end portion of the electrode rod 214 protrudes into the discharge arc chamber of the circular cylindrical ceramic tube 200, is joined (i.e., welded) to a rear end portion of the molybdenum pipe 212 that protrudes from the ceramic tube 200. A lead wire 216 is connected to the molybdenum pipe 212 that protrudes from the ceramic tube 200.

Since the ceramic tube 200 is stable for the metal halogenide, the ceramic arc tube main body has a longer lifetime than the glass arc tube main body. Also, the ceramic tube has a higher heat-resistant temperature than the glass tube. Moreover, the end portion of the ceramic tube 200 is formed of a thin tube portion 200*b* whose inner and outer diameters are smaller than those of a center discharge arc portion 200*a*. Accordingly, a heat radiation from the arc tube end portion whose surface area is small is reduced and the discharge arc chamber is able to be kept at a high temperature, resulting in increased energy conversion efficiency.

Also, the discharge arc portion 200*a* of the ceramic tube 200 is shaped into a circular cylindrical shape. When the sealed material such as the metal halogenide, which is supersaturated, accumulates on the lower portion of the discharge arc chamber, the sealed material gathers around a stepped portion 206 of the pore 201 since this is a coolest point in the discharge arc chamber. As a result, the light emitted downward can be utilized effectively and a desired white light distribution can be obtained.

However, the related art discharge bulb shown in FIG. 10 and described in Japanese Patent Application Publication No. JP-A-2004-362978 still has a number of disadvantages. The stepped portion 206 is formed between the discharge arc portion 200*a* and the thin tube portion 200*b* at both ends of the discharge arc chamber in the ceramic tube 200. It has been found that when an impact force is generated by dropping the related art discharge bulb, or by contacting the discharge bulb with other objects, a stress is concentrated at the root of the thin tube portion 200*b*, causing the thin tube portion 200*b* to bend.

Also, since a thermal stress is applied to the stepped portion 206 due to a temperature difference between the discharge arc chamber and the pores 201 at both ends of the discharge arc chamber, there is a risk that a crack may occur at the root, where the pore opens into the chamber, of the thin tube portion 200*b*.

Also, the sealed material such as the metal halogenide, which is supersaturated and accumulated around the lower area of the stepped portion 206 in the discharge arc portion, tends to enter into a minute clearance 215 between the electrode rod 214 and the molybdenum pipe 212 and accumulates there. Therefore, an amount of the metal halogenide that contributes substantially to the discharge arc is reduced, and a luminous efficiency is lowered. Also, a desired luminous flux cannot be maintained over the long term. More specifically, the minute clearance 215 of, for example, about 25 μm is formed between the electrode rod 214 and the molybdenum pipe 212 in the arc tube main body in order to allow the electrode rod 214 to be inserted into the molybdenum pipe 212 during assembly or to absorb a thermal stress generated in the sealing portion at both ends of the ceramic tube 200. However, since the molybdenum pipe 212 and the electrode rod 214 have a good thermal conductivity, a coolest point of the arc tube main body during lighting is located in the inner part of the minute clearance 215 between the electrode rod 214 and the molybdenum pipe 212. This coolest point is thus far from the discharge arc chamber. Accordingly, the metal halogenide which is sealed in the discharge arc chamber is held as a steam or in a liquid or solid state in the inner part of the minute clearance 215 as the coolest point during the lighting of the arc tube main body, and an amount of the metal halogenide that contributes substantially to the discharge arc is reduced correspondingly. As a result, a luminous efficiency is lowered and a desired luminous flux cannot be obtained.

Also, light distribution of the reflector is shaped by pasting radially a light source image of the arc tube main body around cut-off line/elbow portions of the light distribution patterns onto a light distribution screen arranged in front of the lighting equipment. In this case, since an inner diameter of the arc tube main body (i.e., the discharge arc chamber) is large, the light source image also curves in response to the curved arc and thus the cut-off line of the light distribution pattern also waves. In addition, in many cases the sealed material such as the metal halogenide that is supersaturated tends to accumulate on the center bottom portion of the discharge arc chamber. Therefore, a brightness difference in the pasted light source images is revealed as unevenness of the light distribution in the light distribution pattern since the brightness in the center bottom portion of the discharge arc chamber is low, and thus a proper white light distribution cannot be obtained.

To account for this unevenness, the linear white light source image must be formed by shielding the emergent light to the side or lower portion of the discharge arc chamber (i.e., by shielding the lower half of the arc tube main body in the circumferential direction). Thus, a conversion efficiency into the effective luminous flux decreases since the emergent light is shielded.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

An aspect of the present invention is to provide a discharge bulb that can enhance a mechanical strength of a ceramic arc tube by shaping an end portion of a discharge arc chamber forming wall connected to a pore of thin tube portion into a taper shape, and improve a conversion efficiency into an effective luminous flux by setting an inner diameter of a cylinder portion of the discharge arc chamber forming wall and a projection length of a discharge electrode into the discharge arc chamber to predetermined values respectively, and maintain a luminous flux level over a long term.

According to a first aspect of the present invention, a discharge bulb for a vehicle includes an arc tube main body comprising a discharge arc chamber disposed in a center portion of the arc tube main body in a longitudinal direction, in which two discharge electrodes are disposed to oppose to each other and a luminous material is sealed together with a starting rare gas; a tube portion disposed at each end portion of the arc tube main body, each of the tube portions being in communication with the discharge arc chamber and holding an inserted respective one of the discharge electrodes, wherein a wall for forming the discharge arc chamber has a taper portion whose diameter is reduced gradually from a cylinder portion of the arc tube main body in a center area in the longitudinal direction to the tube portion of the arc tube main body, the taper portion being connected to a pore of the tube portion, and an inner diameter Di of the cylinder portion is about 1.0 mm≦Di≦about 2.5 mm, and a projection length Le of the discharge electrode into the discharge arc chamber is about 1.5 mm≦Le≦about 2.5 mm.

According to another exemplary embodiment of the present invention, an arc tube is provided. The arc tube comprises a discharge arc chamber comprising a center portion having an inner diameter Di, a taper portion at each end in a longitudinal direction of the center portion, and an annular portion at each end of the taper portion in a longitudinal direction, a diameter of the taper portions being gradually reduced in the longitudinal direction from the center portion to the annular portion; two tube portions, one of the tube portions disposed at each end portion in the longitudinal direction of the taper portion of the discharge arc chamber, each of the tube portions being in communication with the discharge arc chamber; and two electrodes, one of the two electrodes being disposed in each of the tube portions, a portion of each of the two electrodes extending through an interior end portion of the corresponding tube portion and into the discharge arc chamber, wherein the annular portion of the discharge arc chamber comprises a space between the interior end portion of the tube portion and the portion of the electrode extending therethrough, Di satisfies a relationship: about 1.0 mm≦Di≦about 2.5 mm, and a length Le of a portion of each of the two electrodes which extends from an interior side of the annular portion into the discharge arc chamber satisfies a relationship: about 1.5 mm≦Le≦about 2.5 mm.

BRIEF DESCRIPTION OF THE DRAWINGS

FIG. 6 is a table showing experimental results of test specimens of the discharge bulb of FIG. 1 in which parameters are varied;

DETAILED DESCRIPTION

Exemplary embodiments of the present invention will be described with reference to the accompanying drawings.

Figure 1:
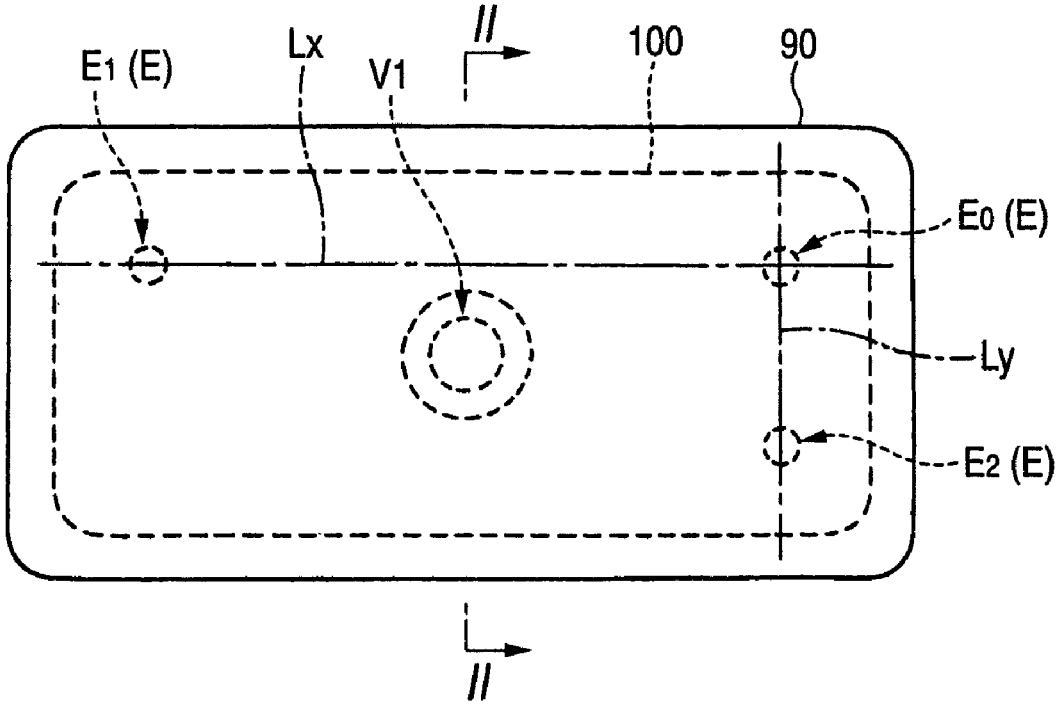
FIG. 1 is a front view showing a vehicle headlamp using a discharge bulb according to a first exemplary embodiment of the present invention as a light source.
Figure 2:
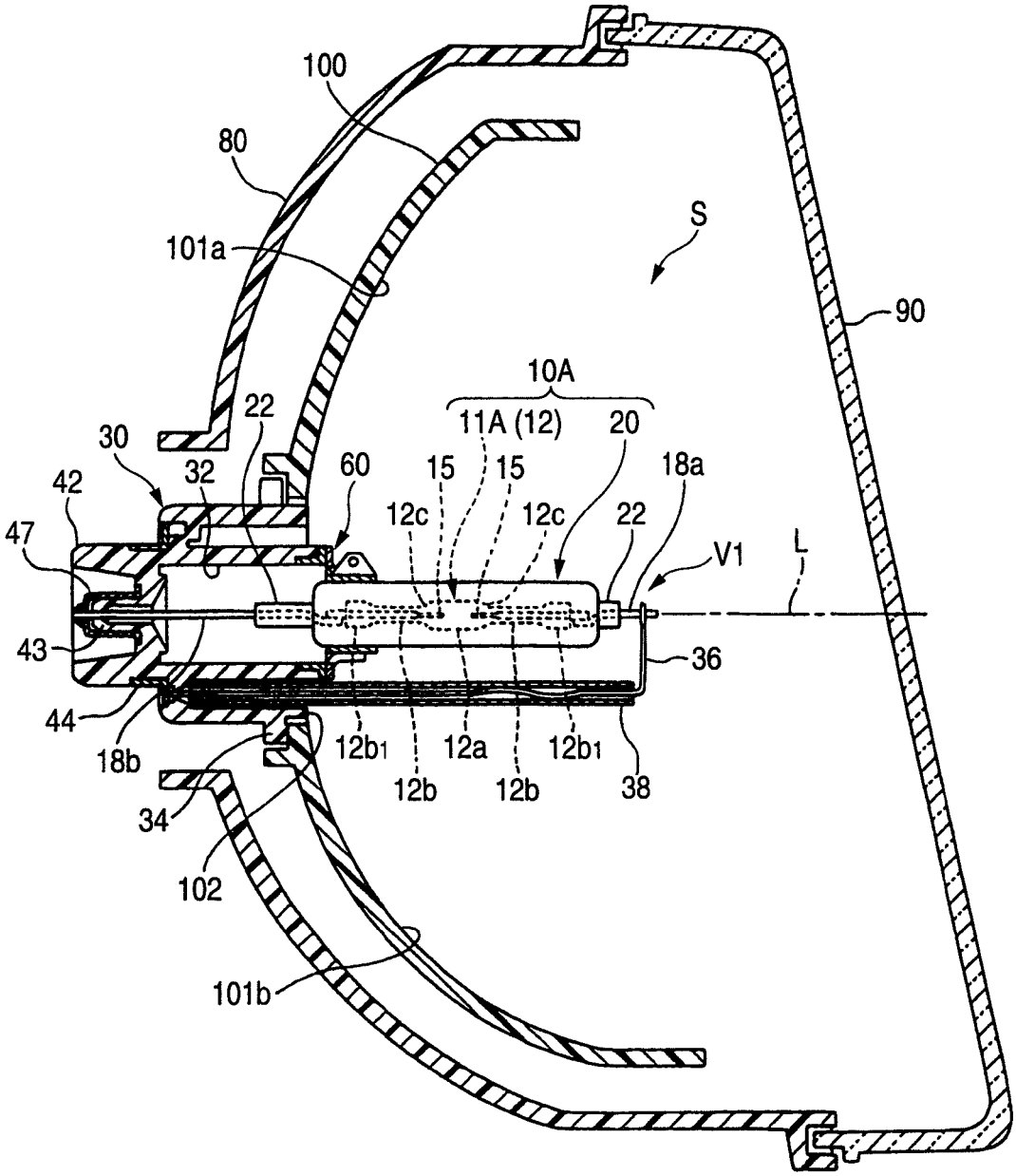
FIG. 2 is a vertical longitudinal sectional view, taken along a line II-II in FIG. 1, of the vehicle headlamp of FIG. 1.

FIG. 1 to FIG. 6 illustrate a discharge lamp according to a first exemplary embodiment of the present invention. Referring now to FIGS. 1 and 2, a discharge lamp comprises a lamp body 80, a front cover 90 and a reflector 100. The lamp body 80 is shaped like a vessel whose front side is opened in a front opening portion. A lamp space S is defined by fitting a transparent front cover 90 to the front opening portion. The reflector 100 in which a discharge bulb V1 is inserted into a bulb fitting hole 102 at the rear top portion is contained in the lamp space S. Effective reflecting surfaces 101*a*, 101*b* on which aluminum is deposited are formed on the inner side of the reflector 100. The effective reflecting surfaces 101*a*, 101*b* are a plurality of light distribution controlling steps (i.e., a plurality of reflecting surfaces) whose curved shape is different respectively. A light distribution pattern is formed by the headlamp when a light emitted from the discharge bulb V1 is reflected by the effective reflecting surfaces 101*a*, 101*b* of the reflector 100 and is irradiated forward.

Also, as shown in FIG. 1, an aiming mechanism E comprising an aiming fulcrum $E_0$ having one ball joint structure, and two aiming screws $E_1$, $E_2$ is interposed between the reflector 100 and the lamp body 80. The aiming mechanism E is constructed such that an optical axis L of the reflector 100 can be tilted with respect to a horizontal tilting axis Lx and a vertical tilting axis Ly by adjusted an aiming of an optical axis Lx or Ly of the reflector 100 respectively.

The discharge bulb V1 comprises an insulating base 30, a focusing ring 34, an arc tube 10A, a metal lead support 36, and a metal supporting member 60. The insulating base 30 is provided. At an outer periphery of the insulating base 30, a focusing ring 34 is provided. The focusing ring 34 is formed of a PPS resin. This focusing ring 34 is engaged with the bulb fitting hole 102 of the reflector 100. An arc tube 10A is supported in front of the insulating base 30 by a metal lead support 36 and a metal supporting member 60 fixed to a front surface of the insulating base 30. The metal lead support 36 provides a current path that protrudes forward from the insulating base 30.

More particularly, a lead wire 18*a* is extended from a front end portion of the arc tube 10A and is secured by spot welding to a bent top end portion of the lead support 36 extended from the insulating base 30. A top end portion of the arc tube 10A is thus held by the bent top end portion of the lead support 36. Also, a lead wire 18*b* is extended from a rear end portion of the arc tube 10A and is connected to a cap-type terminal 47 provided to the rear end portion of the insulating base 30. Also, a rear end portion of the arc tube 10A is clamped by the metal supporting member 60 fixed to a front surface of the insulating base 30.

A recess portion 32 is provided in the front end portion of the insulating base 30, and the rear end portion of the arc tube 10A is inserted in the recess portion 32. Also, a circular column-like boss 43 surrounded by a circular cylinder-like outer cylinder portion 42 extended backward is formed at the rear end portion of the insulating base 30. Also, a circular cylinder-like belt-type terminal 44 which is connected to the metal lead support 36 is fixed integrally to the outer periphery of the root portion of the outer cylinder portion 42. Also, the cap-type terminal 47 to which the rear end side lead wire 18*b* is connected is provided integrally on the boss 43.

Figure 3:
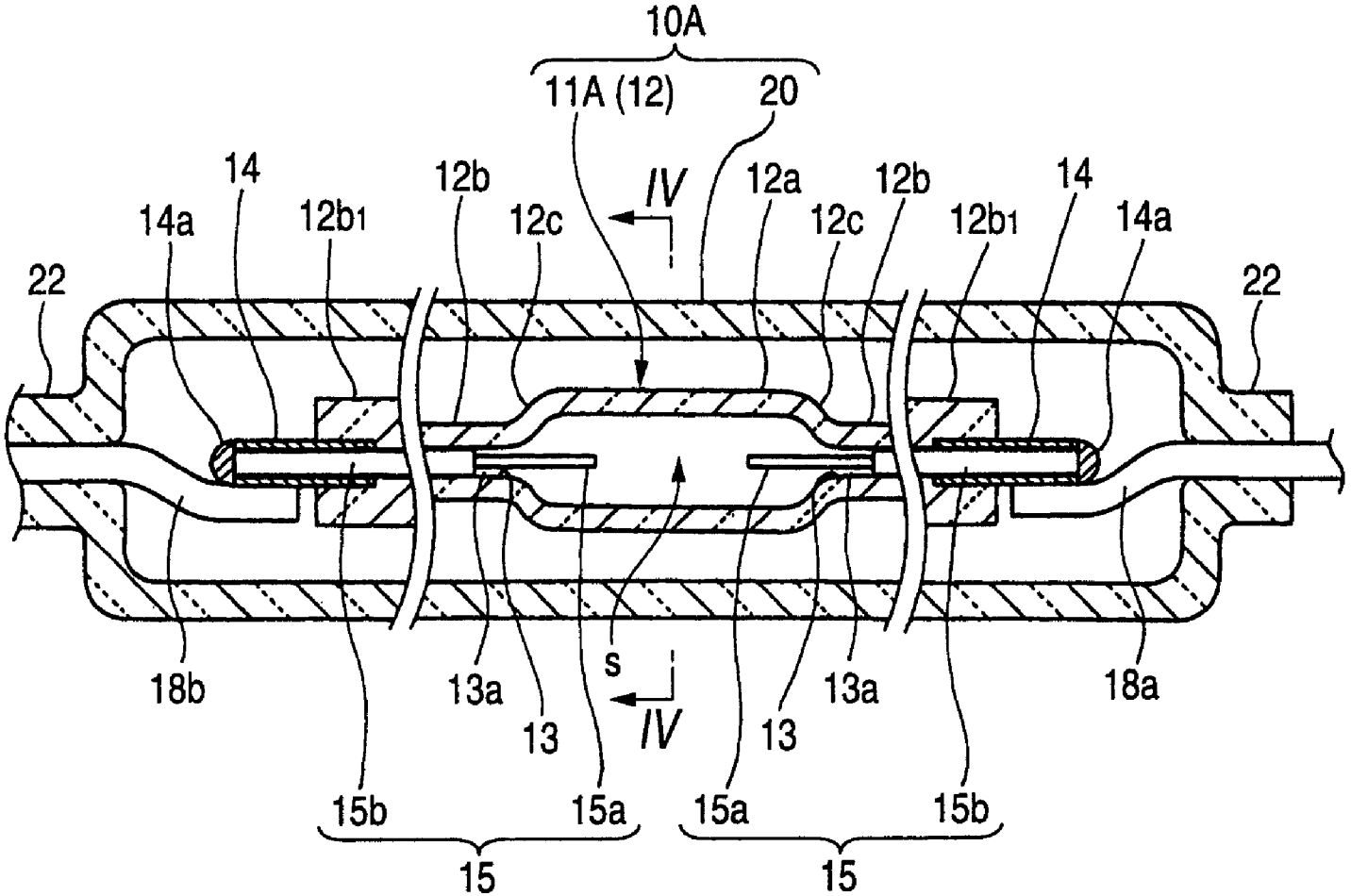
FIG. 3 is an enlarged vertical longitudinal sectional view of an arc tube of the discharge bulb of FIG. 2.
Figure 4:
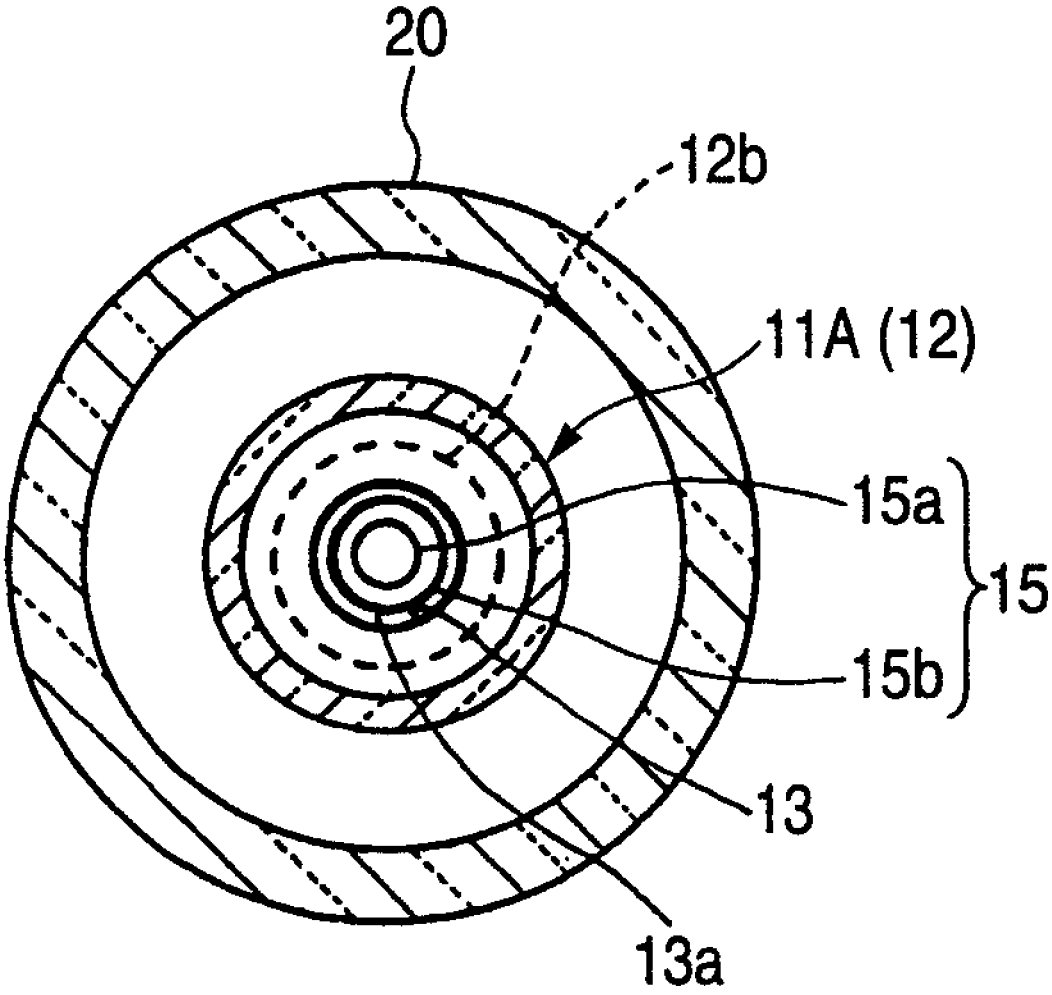
FIG. 4 is a vertical longitudinal sectional view, taken along a line IV-IV in FIG. 3, of the arc tube of FIG. 3.

Turning now to FIG. 3, the arc tube 10A comprises integrally an arc tube main body 11A and a cylindrical shroud glass 20 for covering the arc tube main body 11A to shield ultraviolet rays. This arc tube main body 11A has a discharge arc chamber 's' in which a pair of rod-like electrodes 15, 15 are provided and mutually oppose each other. A luminous material such as, for example, metal halogenide, or the like as well as a starting rare gas is sealed in the discharge arc chamber s. Lead wires 18*a*, 18*b* are pulled out from the front and rear ends of the arc tube main body 11A. The lead wires 18*a*, 18*b* are coupled electrically to the rod-like electrodes 15, 15 that protrude into the discharge arc chamber s. The arc tube main body 11A and the shroud glass 20 are integrated together such that the lead wires 18*a*, 18*b* are sealed by the shroud glass 20. Thus, the shroud glass 20 shields the arc tube main body 11A and the lead wires 18*a*, 18*b* from ultraviolet rays. The glass shroud 20 comprises a diameter-reduced sealing portion 22.

Figure 5:
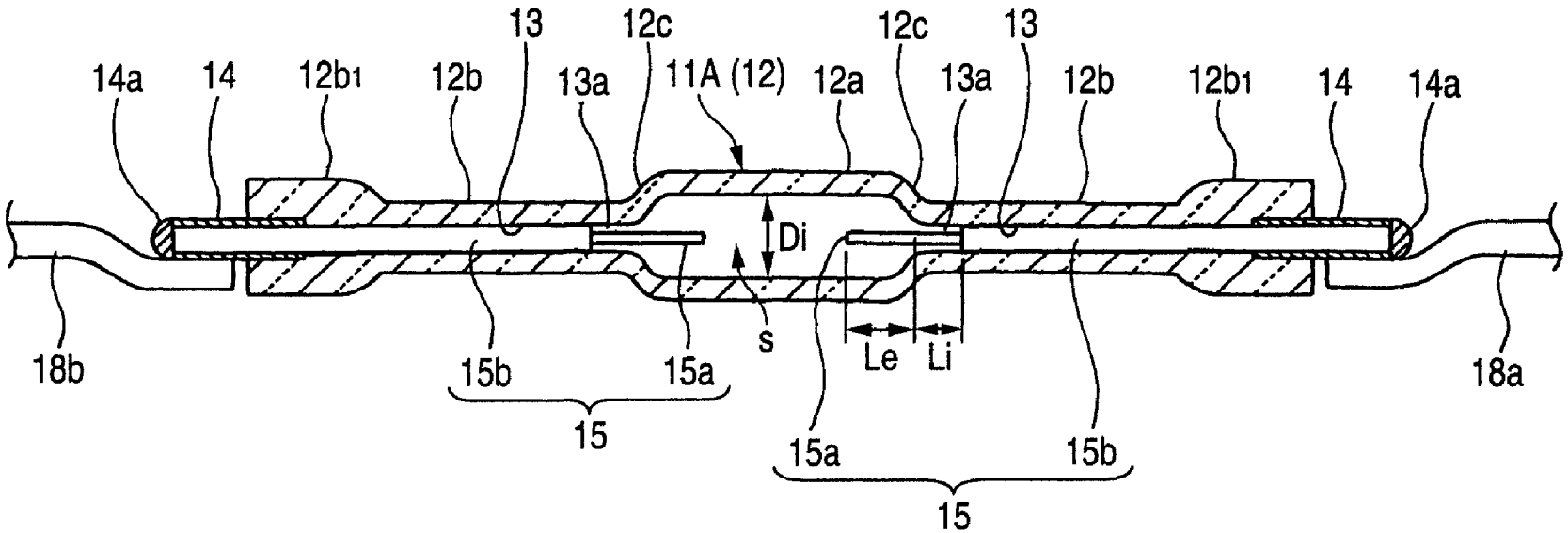
FIG. 5 is an enlarged sectional view of an arc tube of FIG. 3.

As shown in FIG. 5, the arc tube main body 11A comprises a cylindrical translucent ceramic tube 12. A discharge arc portion 12*a* for defining the discharge arc chamber s is formed in a center portion of the ceramic tube 12 in the longitudinal direction. A thin tube portion 12*b* having a pore 13 that communicates with the discharge arc chamber s is provided at both end portions of the ceramic tube 12.

A molybdenum pipe 14 is fixed to an inner peripheral surface of the thin tube portion 12*b* near an opening of the pore 13 by metallization joining such that the molybdenum pipe 14 protrudes from the end portion (i.e., the thin tube portion 12*b*) of the ceramic tube 12. An inner diameter of the molybdenum pipe 14 is equal to or slightly less than an inner diameter of the pore 13 of the thin tube portion 12*b*. A thick cylinder portion $\mathbf{12}b_1$ is formed on an end portion side of the thin tube portion 12*b*, and extends for a length beyond the metallization joined portion. Thus, heat resistance stress strength in the molybdenum pipe joined area of the thin tube portion 12*b* can be secured. The top end portion of the rod-like electrode 15 being inserted into the molybdenum pipe 14 protrudes into the discharge arc chamber s. The rear end portion of the rod-like electrode 15 is joined to the protruded portion of the molybdenum pipe 14, and thus the rod-like electrode 15 is integrated with the ceramic tube 12. Also, the pore 13 communicates with the discharge arc chamber s in which a luminous material such as metal halogenide, or the like as well as the starting rare gas is sealed. A reference 14*a* denotes a laser welded portion.

The rod-like electrode 15 is formed by coaxially joining together a thin tungsten electrode rod 15*a* on the top end side and a thick molybdenum rod 15*b* on the base end side. A minute clearance is formed between the molybdenum pipe 14 and the molybdenum rod 15*b* of the rod-like electrode 15 such that the rod-like electrode 15 can be passed therethrough and a thermal stress generated in the thin tube portion 12*b* can be absorbed. Also, a minute clearance of about 25 μm is formed between the pore 13 and the molybdenum rod 15*b* of the rod-like electrode 15. Bent top end portions of the lead wires 18*a*, 18*b* are fixed to the molybdenum pipe 14 protruding from the thin tube portion 12*b* of the ceramic tube 12 by the welding respectively. The lead wires 18*a*, 18*b* and the rod-like electrodes 15, 15 are arranged coaxially (see, e.g., FIG. 3 and FIG. 5).

An inner diameter Di of the discharge arc portion 12*a* and an electrode projection length Le of the rod-like electrode 15 into the discharge arc chamber s may be set in order to adjust a temperature in the discharge arc chamber s during lighting such that an optimum temperature for the discharge arc is obtained at the electrode top end and such that a taper portion 12*c* is located at a coolest point. In particular, the top end side of the rod-like electrode 15 is formed of a thin stepped electrode rod, and an annular chamber 13*a* that is in communication with the discharge arc chamber s is formed around the tungsten electrode rod 15*a* in the pore 13. In this case, a heat conduction property of the rod-like electrode 15 (i.e., a heat radiation property of the thin tube portion 12*b*) may be adjusted because of the presence of this annular chamber 13*a* such that the metal halogenide sealed in a supersaturated state stagnates on the taper portion 12*c* as the coolest point. Accordingly, a temperature in the discharge arc chamber s may be adjusted such that consumption of the electrode top end is suppressed and the electrode may thus be set to an optimum temperature for the electron emission.

In the arc tube 10A according to the first exemplary embodiment of the present invention, an inner diameter Di of the discharge arc portion 12*a* (i.e., an outer diameter of the discharge arc chamber s) is about 2.2 mm, and a thickness of the ceramic tube 12 (i.e., a thickness of the discharge arc chamber forming wall) is about 0.6 mm. A total length of the discharge arc chamber s is about 7.4 mm. The rod-like electrode 15 is constructed by fitting integrally the tungsten electrode rod 15*a* having an outer diameter of about 0.3 mm to the molybdenum rod 15*b* having an outer diameter of about 0.6 mm. A length of the tungsten electrode rod 15*a* on the top end side is about 3.0 mm, an electrode projection length Le into the discharge arc chamber s is about 1.7 mm, and a distance between the ends of the electrodes 15 within the discharge arc chamber s is about 4.0 mm. An inner diameter of the pore 13 of the thin tube portion 12*b* is about 0.65 mm, a clearance between the pore 13 and the molybdenum rod 15*b* is about 0.025 mm, a length Li of the annular chamber 13*a* is about 1.3 mm, and a length Le+Li of the tungsten electrode rod 15*a* is about 3.0 mm. Also, a tube power of the arc tube main body 11A is about 20 W to about 50 W.

Figure 10:
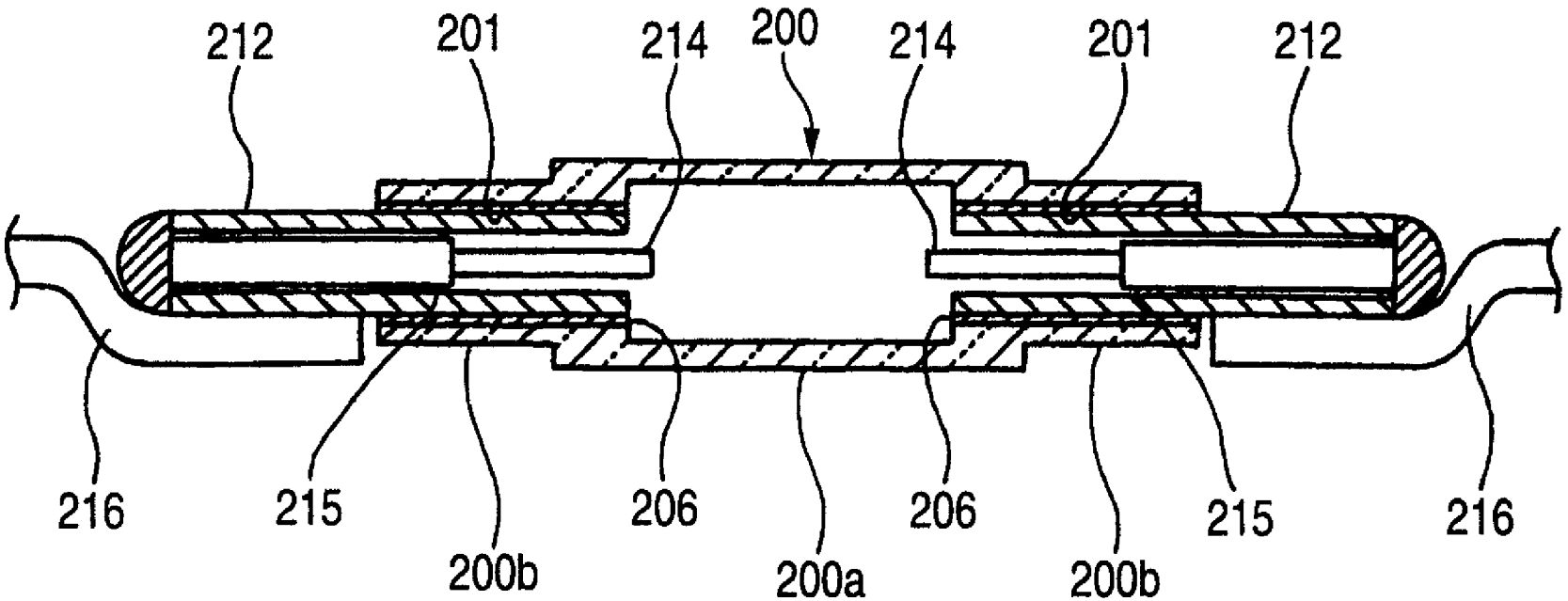
FIG. 10 is a vertical longitudinal sectional view of a related art arc tube of a related art discharge bulb.

In the arc tube main body 11A of the first exemplary embodiment, as shown in FIG. 5, a portion of the discharge arc portion 12*a* that defines the discharge arc chamber s of the ceramic tube 12, which is connected to the thin tube portion 12*b*, is constructed by the taper portion 12*c* whose inner and outer diameters are reduced gradually. That is, a shape of the center portion of the discharge arc chamber forming wall is formed into the circular cylinder shape whose inner and outer diameters are constant in the longitudinal direction, but a shape of the discharge arc chamber forming wall at both end portions is formed into the taper shape whose inner and outer diameters are reduced gradually toward the thin tube portion 12*b* from the center cylindrical portion. Thus, in the first exemplary embodiment of the present invention, the sharp stepped portion 206 of the related art arc tube (see FIG. 10) is eliminated. Therefore, even though an impact force is applied to the arc tube main body 11A (the ceramic tube 12) when the arc tube main body 11A (the ceramic tube 12) is dropped or brought into contact with other members, or the like, such impact force is distributed into the whole taper portion 12*c* and a stress is not concentrated to only a part. Accordingly, the root of the thin tube portion 12*b* is more difficult to bend.

Also, the taper portion 12*c* whose diameter is gradually reduced has a function of making a heat transfer from the discharge arc portion 12*a* to the thin tube portion 12*b* smooth. Therefore, a temperature of the taper portion 12*c* between the discharge arc portion 12*a* and the thin tube portion 12*b* is changed gradually toward the thin tube portion 12*b*, rather than sharply as in the related art. As a result, the thermal stress between the discharge arc portion 12*a* and the thin tube portion 12*b* caused by turning on and off the arc tube main body is minimized and accordingly, the generation of cracks is decreased as compared to the related art.

FIG. 6 is a table showing test results of a number of test specimens according to the first exemplary embodiment of the present invention. More specifically, FIG. 6 shows test specimens #1-#13 in which the values Di, Le, Li and the total length of the discharge arc chamber are varied, where Di is the inner diameter of the center portion of the discharge arc chamber s, Le is a length of the portion of the electrode rod 15*a* which extends from the interior side of the annular member 13*a* into the discharge arc chamber s, and Li is the length of the portion of the electrode rod 15*a* that extends through the annular member 13*a*. (See FIG. 5). For each test specimen #1-#13, the distance between the electrodes was about 4.0 mm. For each test specimen, results are indicated, including luminous efficiency, arc bending, iodide position, conversion efficiency into available luminous flux, durability and total evaluation. The total evaluation is a culmination of the other results. In determining the iodide position, A in the table indicates the iodide position was at a lower portion of the center portion of the arc tube, B indicates the iodide position was at a lower portion (taper portion) of the end portion of the arc tube, and C indicates the iodide position was in at periphery of electrode (inlet portion of the pore).

As the results in FIG. 6 illustrate, test specimens #6, #7, #9 and #12 show the most advantageous results. In the arc tube main body 11A according to the first exemplary embodiment of the present invention, in test specimens #6, #7, and #9, the inner diameter Di of the discharge arc chamber s is small, for example, about 2.2 mm, and thus an arc curvature is corrected by the discharge arc chamber forming wall. Consequently the overall discharge arc portion 12*a* (i.e., the overall discharge arc chamber forming wall) can emit light substantially uniformly. Therefore, a sideward emergent light of the discharge arc portion 12*a* can be utilized as the light distribution.

In test specimens #6, #7, and #9 in the arc tube main body 11A, the electrode projection length Le into the discharge arc chamber s is 1.5 mm for test specimens #6 and #7 and 2.5 for test specimen #9, and the location where the metal halogenide being sealed in a supersaturated state accumulates in the discharge arc chamber s is limited to the taper portion 12*c* of the discharge arc chamber forming wall (i.e., the taper portion 12*c* is the coolest point). Therefore, a downward emergent light of the discharge arc portion 12*a* can be utilized as the white light distribution.

Accordingly, the emergent light from the all circumferences of the cylindrical portion of the discharge arc chamber forming wall that emits light substantially uniformly is not blocked, and therefore the emergent light can be utilized by the reflector as a linear high-intensity light source. That is, the conversion efficiency into the effective luminous flux is high.

Also, the metal halogenide sealed in a supersaturated state accumulates on the lower side of the taper portion 12*c* of the discharge arc chamber forming wall as the coolest point in the discharge arc chamber s. The sealed metal halogenide (liquid) that accumulates on the taper portion 12*c* is vaporized immediately because the inside of the discharge arc chamber s becomes a high temperature and a high pressure, and the sealed metal halogenide never stagnates in the pore 13 because the pore 13 does not become the coolest point (i.e., the minute clearance between the pore 13 and the rod-like electrode 15). Therefore, an amount of metal halogenide that contributes substantially to the discharge arc is not reduced, resulting in a luminous efficiency that is high.

Also, the top end of the electrode rod 15*a* is not positioned at the taper portion 12*c* but positioned to protrude into the cylinder portion of the discharge arc chamber forming wall. The taper portion 12*c* of the discharge arc chamber forming wall is positioned to surround not the arc but the electrode 15*a*. Therefore, the arc generated between the opposing electrodes opposes substantially to the cylinder portion of the discharge arc chamber forming wall, so that the metal halogenide sealed in a supersaturated state accumulates in the taper portion 12*c* of the discharge arc chamber forming wall and does not accumulate in the cylinder portion of the discharge arc chamber forming wall. As a result, the emergent light emitted to the lower side of the cylinder portion of the discharge arc chamber forming wall can be utilized effectively.

In other words, when the overall discharge arc chamber forming wall is used as the linear light source image, the luminance of the taper portion 12*c* that is not positioned to surround the arc is lower than the luminance of the cylinder portion of the discharge arc chamber forming wall. Moreover, the emergent light from the taper portion 12*c* is hard to use as the light distribution because it is colored in a same color as the accumulated metal halogenide. Therefore, the emergent light from the taper portion 12*c* of the discharge arc chamber forming wall must be blocked. In this case, the emergent light from the end portion of the arc tube main body (the taper portion 12*c*) is blocked essentially as the improper distribution light in the related-art. Even though the proper light distribution pattern is formed by utilizing merely the whole cylinder portion of the discharge arc chamber forming wall, which gives the white arc over the overall arc and has a high intensity, as the linear light source while blocking the light from the taper portion 12*c* like the related-art, a reduction of the conversion efficiency into the effective luminous flux is never caused.

Also, in the arc tube main body 11A shown in test specimens #6, #7, and #9, a sum Li+Le of the length Li of the annular chamber 13*a* and the projection length Le of the tungsten electrode rod 15*a* into the discharge arc chamber s (this is equal to a total length of the tungsten electrode rod 15*a*) is 3.0 mm. Thus, a temperature in the discharge arc chamber s may be adjusted such that a temperature at the top end of the electrode is set to the optimum temperature for the discharge arc.

In other words, as shown in test specimen #13 (Li+Le=3.2 mm) in FIG. 6, when Li+Le exceeds about 3.0 mm, an amount of the tungsten rod 15*a* having a small diameter on the top end side to a total length of the rod-like electrode 15 becomes excessively large (an amount of the thick molybdenum rod 15*b* of a large diameter on the base end side becomes excessively small, and the length Li of the annular chamber 13*a* becomes excessively large) and also a heat conduction property of the rod-like electrode 15 is lowered. Thus, consumption of the top end of the electrode rod being exposed to a high temperature in the discharge arc chamber s is increased severely, and also a luminous efficiency is lowered sharply.

In contrast, as shown by test specimen #11 (Li+Le=about 1.5 mm) in FIG. 6, when Li+Le is below about 2.0 mm, an amount of the tungsten rod 15*a* having a small diameter on the top end side to a total length of the rod-like electrode 15 becomes excessively small (i.e., an amount of the thick molybdenum rod 15*b* of a large diameter on the base end side becomes excessively large, and the length Li of the annular chamber 13*a* becomes excessively small) and also a heat conduction property of the rod-like electrode 15 is increased. Thus, consumption of the top end of the electrode rod can be avoided, but a temperature of the electrode top end is decreased and thus the electron emission becomes insufficient, whereby a luminous efficiency is also lowered.

In this manner, as shown by test specimens #6, #7, #9, and #12, when the inner diameter Di of the cylinder portion of the arc tube main body 11 is about 1.0≦Di≦about 2.5 mm and the projection length Le of the discharge electrode into the discharge arc chamber s is about 1.5≦Le≦about 2.5 mm, a reduction of the luminous efficiency caused due to the fact that an amount of the metal halogenide that contributes to the discharge arc is reduced because the sealed the metal halogenide stays in the thin tube portion can be eliminated. However, in order to suppress reduction of the luminous efficiency caused due to the fact that a temperature of the electrode top end is lowered and the electron emission becomes insufficient or to suppress a reduction of the luminous efficiency caused due to the consumption of the electrode top end exposed to the high temperature, it is advantageous that Li+Le satisfy the relationship about 2.0≦Li+Le≦about 3.0 mm.

As shown in FIG. 6, it is advantageous for the the inner diameter Di of the discharge arc portion 12*a* (outer diameter of the discharge arc chamber s) to be in a range of about 1.0 mm to about 2.5 mm from both aspects of the heat resistance property and the conversion efficiency into the effective luminous flux. That is, in test specimens #5 and #8 in which the inner diameter of the discharge arc portion 12*a* was 3 mm, the luminous efficiency is not bad, but the arc curvature is too large, e.g., about 0.8 mm, because Di is large. Thus, either the cut-off lines of the light distribution pattern wave or a brightness difference in the pasted light source images appears as unevenness of the light distribution in the light distribution patterns. When Di is further increased, the sealed metal halogenide stays in the center of the discharge arc portion 12*a* and the downward emergent light cannot be utilized. Therefore, almost an entire lower half of the arc tube is blocked, and only the upper half can be utilized as a light source, and thus the conversion efficiency into the effective luminous flux is deteriorated by the shielding.

Meanwhile, in test specimen #2 in FIG. 6 in which Di is 0.8 mm, since the outer diameter Di of the discharge arc chamber s is too small, the arc always contacts the tube wall and thus a thermal load on the tube wall is increased, resulting in a decreased durability of the arc tube.

In turn, in test specimens #1, #3, #4, #6, #7, and #9 to #13 in which the inner diameter Di of the discharge arc portion 12*a* (the outer diameter Di of the discharge arc chamber s) is relatively small such as 1.0 mm, 2.0 mm or 2.5 mm, since the arc curvature is small, neither the cut-off lines of the light distribution pattern wave nor brightness difference in the pasted light source images appears as unevenness of the light distribution in the light distribution patterns.

Also, in test specimens #1, #3, and #4 out of test specimens #1, #3, #4, #6, #7, and #9 to #13, the projection length Le of the discharge electrode 15 into the discharge arc chamber s is too short. Conversely, in test specimen #10, the projection length Le of the discharge electrode 15 into the discharge arc chamber s is too long. In both cases, the luminous efficiency is bad.

More specifically, even though the inner diameter Di of the cylinder portion of the discharge arc chamber forming wall is about 1 mm or about 2.5 mm that gives an excellent conversion efficiency into the effective luminous flux, the arc is formed over the discharge arc chamber s and also a temperature distribution in the discharge arc chamber is substantially constant when the projection length Le of the discharge electrode 15 into the discharge arc chamber s is below about 1.0 mm, as for example in test specimens #1, #3, and #4. Consequently, a temperature near the electrode (i.e., an inlet portion of the pore) becomes lower than the coolest point in the discharge arc chamber s and an inside of the thin tube portion (i.e., the pore) goes to the coolest point, and thus the metal halogenide sealed in a supersaturated state stagnates in the thin tube portion (i.e., in the minute clearance between the pore and the electrode). As a result, an amount of the metal halogenide that contributes substantially to the discharge arc is reduced, and a luminous efficiency is lowered.

In contrast, in test specimen #10, when the projection length Le of the discharge electrode 15 exceeds about 2.5 mm, the arc is formed around the center portion of the discharge arc chamber s and thus a deviation of a temperature distribution in the discharge arc chamber s is caused. Therefore, although the coolest point is positioned on the lower side of the taper portion of the discharge arc chamber forming wall, a temperature of the coolest point is too low and the luminous efficiency is lowered.

As a consequence, in order to suppress a reduction of the amount of the metal halogenide that contributes to the discharge arc, prevent a reduction of the luminous efficiency, and maintain a desired luminous flux for a long term, it is advantageous that the inner diameter Di of the cylinder portion of the discharge arc chamber forming wall is in a range of about 1.0 mm to about 2.5 mm and the projection length Le of the discharge electrode into the discharge arc chamber is in a range of about 1.5≦Le≦about 2.5 mm, as in test specimens #6, #7, #9, and #11 to #13.

Also, in test specimen #13 out of test specimen #6, #7, #9, and #11 to #13, the length (Li+Le) of the thin tungsten electrode rod 15*a* is in excess of about 3.0 mm, and the length of the thin tungsten electrode rod 15*a* becomes longer than the length of the thick molybdenum rod 15*b* (the length Li of the annular chamber 13*a* is too long). Therefore, a heat conduction property of the rod-like electrode 15 (a heat radiation property of the arc tube end portion) is lowered, consumption of the top end of the electrode rod being exposed to a high temperature in the discharge arc chamber s is increased severely, and also a luminous efficiency is lowered sharply.

In contrast, in test specimen #11, the length (Li+Le) of the thin tungsten electrode rod 15*a* is below about 2.0 mm, and the length of the thin tungsten electrode rod 15*a* becomes shorter than the length of the thick molybdenum rod 15*b* (the length Li of the annular chamber 13*a* is too short), i.e., the length of the thick molybdenum rod 15*b* is longer than the length of the thin tungsten electrode rod 15*a*. Therefore, a heat conduction property of the rod-like electrode (a heat radiation property of the arc tube end portion) is increased and thus consumption of the top end of the electrode rod can be avoided, but a temperature of the electrode top end is decreased and thus the electron emission becomes insufficient, so that a luminous efficiency is also lowered.

Therefore, out of the test specimens #6, #7, #9, and #11 to #13 in FIG. 6, test specimens #6, #7, #9, and #12 are advantageous.

Figure 7:
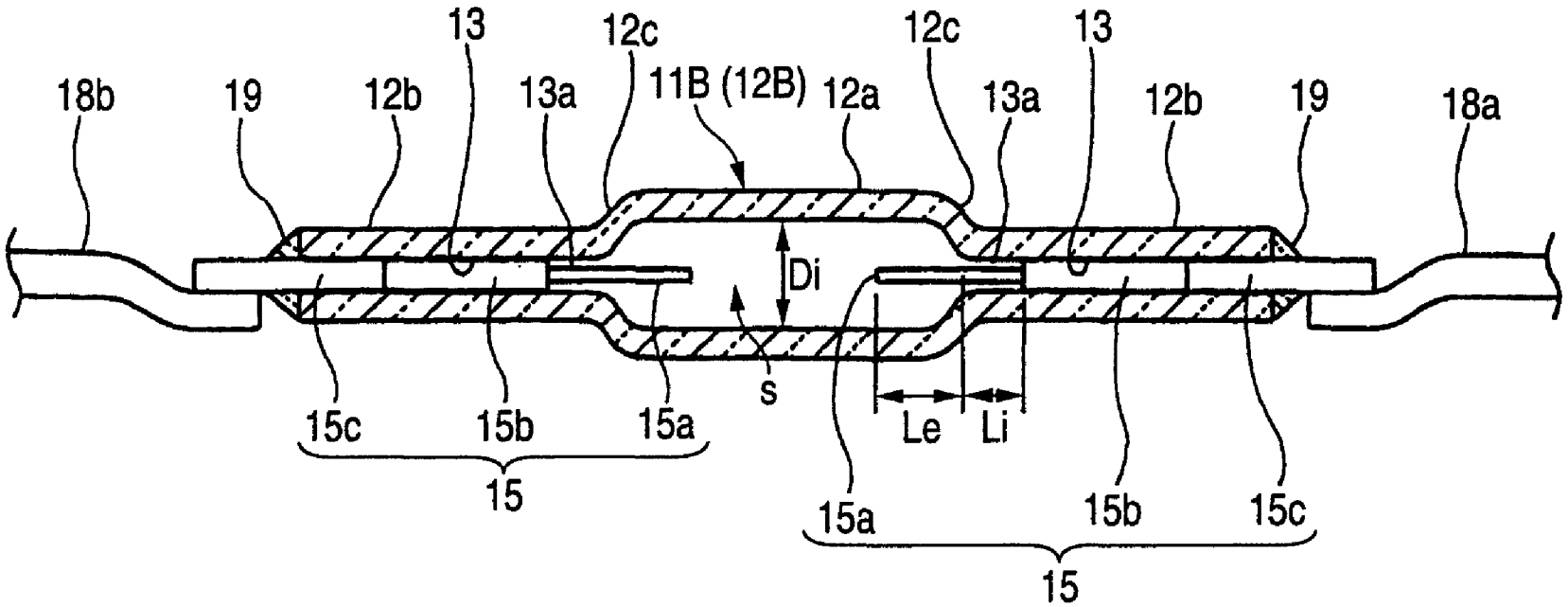
FIG. 7 is a vertical longitudinal sectional view of an arc tube of a discharge bulb according to a second exemplary embodiment of the present invention.

FIG. 7 is a vertical longitudinal sectional view of an arc tube main body of a discharge bulb according to a second exemplary embodiment of the present invention.

The arc tube main body 11A according to the first exemplary embodiment has such a configuration that the rod-like electrode 15 is integrated with the ceramic tube 12 via the molybdenum pipe 14 that is joined to the pore 13 of the thin tube portion 12*b* of the ceramic tube 12. An arc tube main body 11B according to the second exemplary embodiment has a configuration that the rod-like electrode 15 is directly joined to a ceramic tube 12B by frit glass sealing.

More specifically, like the ceramic tube 12 of the above-described first exemplary embodiment, the ceramic tube 12B of the arc tube main body 11B is shaped into the cylindrical shape as a whole, but an outer diameter of the thin tube portion 12*b* formed at both ends of the discharge arc portion 12*a* being positioned in the center portion in the longitudinal direction is formed constant in the longitudinal direction. Also, the rod-like electrode 15 on the base end portion side comprises a joined body of the molybdenum rod 15*b* and a niobium rod 15*c*. The pore 13 that communicates with the discharge arc chamber s of the discharge arc portion 12*a* is provided in the thin tube portion 12*b*.

Also, the rod-like electrode 15 is inserted into the pore 13 such that the tungsten electrode rod 15*a* protrudes into the discharge arc chamber. The niobium rod 15*c* on the rear end side of the rod-like electrode 15 protrudes from the thin tube portion 12*b* and is integrated with the end surface of the thin tube portion 12*b* by glass deposition. A reference 19 denotes a glass deposited portion. The bent portions of the lead wires 18*a*, 18*b* are joined to the end portion of the rod-like electrode 15 (the niobium rod 15*c*) protruded from the thin tube portion 12*b* respectively, and the ceramic tube 12B and the lead wires 18*a*, 18*b* extend in a coaxial manner.

As described above, the rod-like electrode 15 is formed by joining integrally the tungsten electrode rod 15*a* on the top end side, the thick molybdenum rod 15*b* on the base end portion side, and the niobium rod 15*c* in a coaxial fashion. Also, the minute clearance of about 25 μm is formed between the rod-like electrode 15 and the pore 13 of the thin tube portion 12*b* such that the rod-like electrode 15 can be inserted into the clearance and a thermal stress generated at both ends of the ceramic tube 12C can be absorbed.

Other portions of the arc tube main body 11B have a same configurations as those of the arc tube main body 11A according to the first exemplary embodiment, and their explanation will thus be omitted. In this case, the arc tube main body 11B is similar to the arc tube main body 11A according to the first exemplary embodiment in that the shroud glass 20 for covering the arc tube main body 11B is integrated with the lead wires 18*a*, 18*b*.

In the arc tube main body 11B according to the second exemplary embodiment, as in the arc tube main body 11A according to the first exemplary embodiment, a mechanical strength of the ceramic tube and a high conversion efficiency into the effective luminous flux can be assured, and a desired luminous flux can be maintained over the long term.

FIGS. 8A to 9D are views showing operations for manufacturing the ceramic tube 12B of the arc tube main body 11B having the frit glass sealing structure shown in the second exemplary embodiment.

In a related art method of manufacturing the ceramic type tube, an inner die that matches the inner shape of the ceramic tube is inserted into a molding die whose inner peripheral surface matches the outer shape of the ceramic tube. The ceramic material filled around the inner mold is sintered, and the inner die is melted. However, the related has a number of disadvantages. First, in the related art method, melting the inner die is needed, resulting in increased cost. Also, an impurity remains on the inside of the shaped ceramic tube.

It is an aspect of the present invention to provide an improved method of manufacturing the ceramic tube.

A method of manufacturing a ceramic tube according to a third exemplary embodiment of the present invention will now be described with reference to FIGS. 8A to 8D.

Figure 8A:
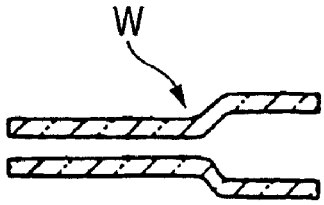
FIGS. 8A to 8D are explanatory views showing a method of manufacturing the arc tube of FIG. 7, according to a third exemplary embodiment of the present invention.

As shown in FIG. 8A, a split body W in which the ceramic tube is split into two pieces in a center portion of the discharge arc chamber forming wall in the longitudinal direction is manufactured. In other words, the ceramic material is filled in a molding die that comprises an outer die whose inner peripheral surface matches an outer shape of the ceramic tube 12B and an inner die whose outer peripheral surface matches an inner shape of the ceramic tube 12B, and then the split body W as the moldings is molded by the sintering. Then, the split body W as the moldings can be taken out simply by opening the molding die. Therefore, unlike the method in the related-art, the troublesome step of melting the inner die (i.e., a core) is not needed.

Figure 8B:
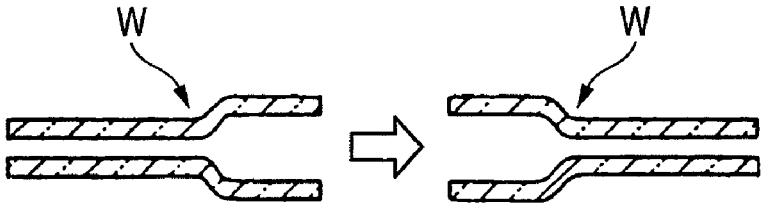
Figure 8C:
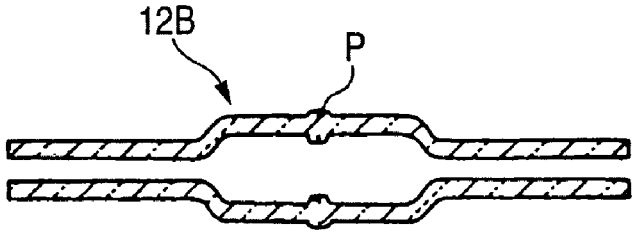
Figure 8D:
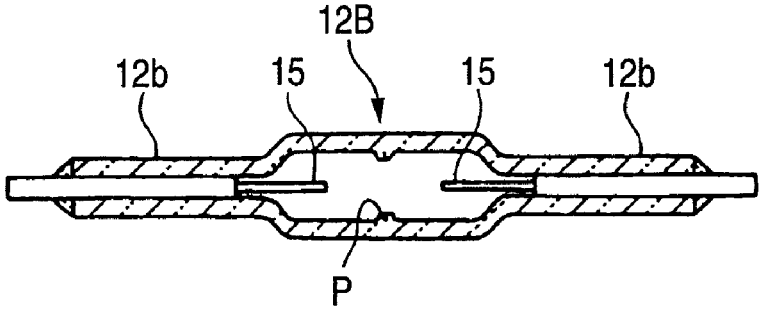

Then, as shown in FIG. 8B, mutual end surfaces of the discharge arc chamber forming walls of two molded split bodies W, W are butted together, and then butted portions are deposited together by sintering, or the like. Then, as shown in FIG. 8C, since a sintered mark P remains along the butted portion in the integrated discharge arc chamber forming walls, the sintered mark P is polished from the outside of the discharge arc chamber forming walls. Then, as shown in FIG. 8D, the rod-like electrode 15 is inserted into the thin tube portion 12*b* and then the rod-like electrode 15 is glass-deposited to the end surface of the thin tube portion 12*b*.

A method of manufacturing a ceramic tube according to a fourth exemplary embodiment of the present invention will now be described with reference to FIGS. 9A to 9D.

Figure 9A:
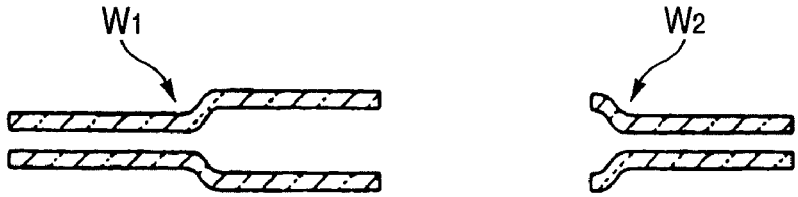
FIGS. 9A to 9D are explanatory views showing another method of manufacturing the arc tube of FIG. 7, according to a fourth exemplary embodiment of the present invention.

As shown in FIG. 9A, respective split bodies $W_1$, $W_2$ obtained by splitting the ceramic tube 12B into two pieces at a boundary between the cylinder portion of the discharge arc chamber forming wall and the taper portion or near a boundary are manufactured. More specifically, the ceramic material is filled in two type molding dies each comprising an outer die whose inner peripheral surface matches the outer shape of the split ceramic tube 12B and an inner die whose outer peripheral surface matches the inner shape of the split ceramic tube 12B, and then first and second split bodies $W_1$, $W_2$ as the moldings are formed by the sintering. Since the first and second split bodies $W_1$, $W_2$ as the moldings can be taken out simply by opening the molding dies, the troublesome step of melting the inner die (core) is not needed, unlike in the related art method. Also, even though an impurity remains in the cylinder portions of the first and second split bodies $W_1$, $W_2$, such impurity can be removed simply.

Figure 9B:
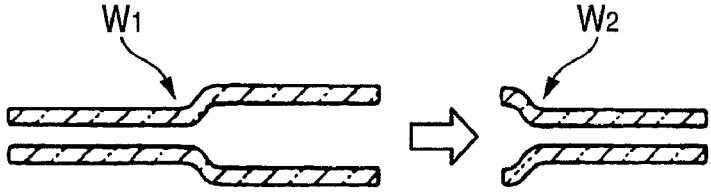
Figure 9C:
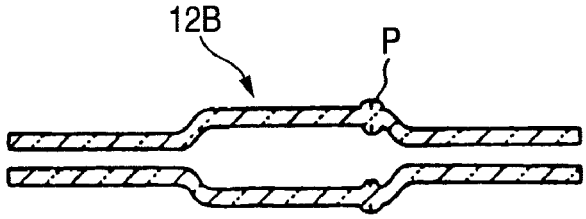

Then, as shown in FIG. 9B, mutual end surfaces of the discharge arc chamber forming walls of two type split bodies (the first and second split bodies) $W_1$, $W_2$ after molded are butted together, and then butted portions are deposited together by sintering, or the like. Then, as shown in FIG. 9C, since the sintered mark P remains along the butted portion in the integrated discharge arc chamber forming walls, the sintered mark P is polished from the outside of the discharge arc chamber forming walls. Then, as shown in FIG. 9D, the rod-like electrode 15 is inserted into the thin tube portion 12*b* and then the rod-like electrode 15 is glass-deposited to the end surface of the thin tube portion 12*b*.

Figure 9D:
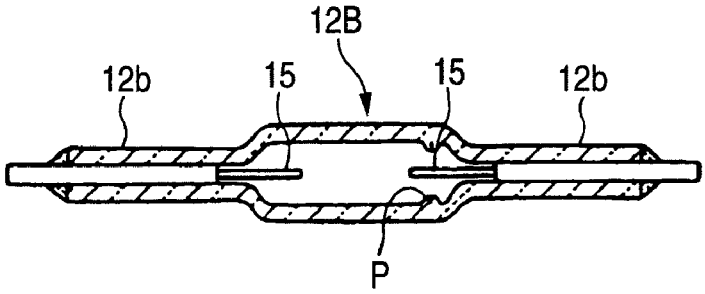

In the arc tube main body using a ceramic tube manufactured by a method according to the fourth exemplary embodiment of the present invention shown in FIGS. 9A to 9D, it is advantageous that, as shown in FIG. 9D, the top end portion of the rod-like electrode should protrude into the cylinder portion of the discharge arc chamber forming wall beyond the jointed portion of the discharge arc chamber forming wall.

Also, in the method according to the third exemplary embodiment of the present invention shown in FIGS. 8A to 8D, sometimes the sintered mark P still remains on the inner side of the center portion of the discharge arc portion 12*a*. Therefore, the sintered mark P may exert an influence upon the light distribution. In contrast, in the method according to the fourth exemplary embodiment shown in FIGS. 9A to 9D, even when the sintered mark P remains on the inner side of the discharge arc portion 12*a*, the sintered mark P does not exist in the taper position 12*c* or in the position that is located near the taper position 12*c* and corresponds to the area between the opposing electrodes between which the arc is formed. This taper position 12*c* or the neighborhood of this taper position 12*c* corresponds to the portion that is shielded by light shielding film or the like to form a linear light source that emits a light uniformly. Therefore, the taper position 12*c* or the neighborhood of the taper position 12*c* where the sintered mark P still remains is shield by the light shielding film or the like in order to form a light distribution, a utilization factor of the effective luminous flux is never lowered in forming the light distribution.

In the arc tube according to the first and second exemplary embodiments of the present invention, when a shape of the end portion of the discharge arc chamber forming wall in the ceramic tube (a shape between the discharge arc chamber forming wall and the thin tube portion) is formed like a taper (formed by a taper portion), a diameter of the center circular cylinder is reduced gradually toward the thin tube portion, and an impact stress generated between the discharge arc chamber forming wall and the thin tube portion of the arc tube main body (the ceramic tube) when the arc tube main body (the ceramic tube) is dropped or brought into contact with other member is distributed into the whole taper portion (a stress concentration between the discharge arc chamber forming wall and the thin tube portion is relaxed), so that the root of the thin tube portion is hard to bend and a large thermal stress for causing a crack is never generated between the discharge arc chamber forming wall and the thin tube portion in turning on/off the bulb because heat transfer from the discharge arc chamber forming wall to the thin tube portion becomes smooth.

Also, in arc tube according to the first and second exemplary embodiment of the present invention, when a shape of the end portion of the discharge arc chamber forming wall in the ceramic tube is shaped into a taper portion and also an inner diameter Di of a cylinder portion of the discharge arc chamber forming wall (outer diameter of the discharge arc chamber) and a projection length Le of the discharge electrode into the discharge arc chamber are set to predetermined sizes respectively, a temperature distribution in the arc tube (the discharge arc chamber) can be adjusted.

Then, as shown in FIG. 6, various experiments have been made while changing the inner diameter Di of the cylinder portion of the discharge arc chamber forming wall, the projection length Le of the discharge electrode into the discharge arc chamber, and the like. As a result, it has been verified that, when Di is set in a range of about 1.0 to about 2.5 mm and Le is set in a range of about 1.5 to about 2.5 mm, a reduction of the luminous efficiency (reduction of the luminous flux) due to the fact that the sealed metal halogenide accumulates in the minute clearance between the pore and the electrode (due to a reduction of an amount of the metal halogenide that contributes substantially to the discharge arc) does not appear and also a light distribution can be formed unless the side portion and the lower portion of the arc tube main body are shielded, so that a conversion efficiency into the effective luminous flux can be improved.

Also, according to the second exemplary embodiment of the present invention, the ceramic arc tube main body having a frit glass sealing structure in which the electrode rod is inserted into the pores at both end portions of the ceramic tube through the minute clearance and projected portions of the electrode rod protruding from both end portions of the ceramic tube are glass-deposited to the end portion of the ceramic tube is also provided. It has been verified that, in the arc tube main body having the frit glass sealing structure, similar results to those shown in FIG. 6 for the jointed structure are also effective.

Also, in the arc tube according to the first and second exemplary embodiments of the present invention, when the end portion of the discharge arc chamber forming wall is formed by the taper portion and, the inner diameter Di of the cylinder portion of the discharge arc chamber is set in a range of about 1.0 mm to about 2.5 mm and the projection length Le of the discharge electrode into the discharge arc chamber is set in a range of about 1.5 to about 2.5 mm, the heat resistance of the arc tube can be secured and neither unevenness of the light distribution in the formed light distribution is caused nor cut-off lines wave. In addition, the sealed metal halogenide does not stay in the thin tube portion in the discharge arc chamber. Therefore, an amount of the sealed metal halogenide that contributes substantially to the discharge arc is reduced correspondingly.

In other words, when the inner diameter Di of the cylinder portion of the discharge arc chamber forming wall is too small (Di is below about 1.0 mm), the arc always contacts the tube wall and thus a thermal load on the tube wall is increased and influences the durability of the arc tube. In contrast, when the inner diameter Di of the cylinder portion of the discharge arc chamber forming wall is too large (Di exceeds about 2.5 mm), the sealed metal halogenide stays in the center of the discharge arc chamber. Thus, various problems are caused such that the cut-off lines of the light distribution patterns wave because of the curved arc, and unevenness of the light distribution in the light distribution patterns becomes apparent, and the like. Therefore, it is advantageous to set the inner diameter Di of the cylinder portion of the discharge arc chamber forming wall to a range of about 1.0 mm to about 2.5 mm.

In more detail, when the inner diameter Di of the cylinder portion of the discharge arc chamber forming wall is reduced to about 2.5 mm or less, an arc curvature is corrected by the discharge arc chamber forming wall and the arc is shaped into a straight shape (i.e., a rectangle). Therefore, a sideward emergent light of the discharge arc chamber forming wall can be utilized as the light distribution. In addition, the location where the metal halogenide being sealed in a supersaturated state accumulates is limited to the pore as the coolest point or the taper portion of the discharge arc chamber forming wall. Therefore, a downward emergent light of the discharge arc chamber forming wall can be utilized effectively as the white light distribution. As a result, the emergent light from the entire circumference of the cylindrical portion of the discharge arc chamber forming wall that emits the light substantially uniformly is not blocked, but rather the emergent light can be utilized by the reflector as a linear high-intensity light source.

Concretely, a light distribution design of the reflector may be more easily carried out by pasting radially a light source image of the arc tube onto the light distribution screen arranged in front of the lighting equipment. At this time, when Di is set to about 2.5 mm or less, firstly the light source image is not curved and has a rectangular shape and thus the cut-off lines of the light distribution patterns do not wave and show a straight line. Secondly, the metal halogenide being sealed in a supersaturated state stagnates in the pore or the taper portion in the discharge arc chamber but does not stagnate around the center area in the discharge arc chamber, so that the overall discharge arc chamber has a uniform brightness (i.e., the pasted light source images have a uniform brightness over the whole light source image). Therefore, when Di is set to about 2.5 mm or more, the emergent light from the entire circumference of the discharge arc chamber forming wall that emits the light with substantially uniform brightness is not blocked, but rather such light can be utilized in a light distribution design of the reflector as a linear high-intensity light source. As a result, neither the cut-off lines of the light distribution patterns wave nor unevenness of the light distribution in the light distribution patterns appears, so that a visibility can be improved and the conversion efficiency into the effective luminous flux can be enhanced.

Also, even though the inner diameter Di of the cylinder portion of the discharge arc chamber forming wall is set to a range of about 1.0 to about 2.5 mm that gives the excellent conversion efficiency into the effective luminous flux, the arc is formed over the discharge arc chamber s and also a temperature distribution in the discharge arc chamber is substantially constant when the projection length Le of the discharge electrode into the discharge arc chamber is below about 1.5 mm (e.g., about 0.5 mm). Consequently, a temperature near the electrode (an inlet portion of the pore) becomes lower than the coolest point in the discharge arc chamber s and an inside of the thin tube portion (the pore) goes to the coolest point, and thus the metal halogenide sealed in a supersaturated state stagnates in the thin tube portion (the minute clearance between the pore and the electrode). As a result, an amount of the metal halogenide that contributes substantially to the discharge arc is reduced, and a luminous efficiency is lowered.

In contrast, when the electrode projection length Le exceeds about 2.5 mm (e.g., about 2.8 mm), the arc is formed around the center portion of the discharge arc chamber and thus a deviation of a temperature distribution in the discharge arc chamber is caused. Therefore, although the coolest point is positioned on the lower side of the taper portion of the discharge arc chamber forming wall, a temperature of the coolest point is too low and the luminous efficiency is lowered.

Accordingly, to maintain a desired luminous flux for a long term without reduction of the luminous efficiency, it is advantageous that the inner diameter Di of the cylinder portion of the arc tube main body be set to a range of about 1.0 to about 2.5 mm) and the projection length Le of the discharge electrode into the discharge arc chamber be set to a range of about 1.5 to about 2.5 mm.

Also, in the arc tube according to the first and second exemplary embodiments of the present invention, the lower side of the taper portion of the discharge arc chamber forming wall in the arc tube main body arrange horizontally serves as the coolest point, and the metal halogenide (liquid) sealed in a supersaturated state accumulates on the lower side of the taper portion of the discharge arc chamber forming wall. However, the sealed metal halogenide (liquid) that accumulates on the lower portion of the taper portion is vaporized immediately because the inside of the discharge arc chamber becomes a high temperature and a high pressure, and the sealed metal halogenide never stagnates in the pore that does not become the coolest point (the minute clearance between the pore and the rod-like electrode). Therefore, an amount of metal halogenide that contributes substantially to the discharge arc is not reduced, and a luminous efficiency is not lowered correspondingly.

In the arc tube according to the first and second exemplary embodiments of the present invention, the arc generated between the opposing electrodes opposes substantially to the cylinder portion of the discharge arc chamber forming wall, so that the metal halogenide sealed in a supersaturated state accumulates in the taper portion of the discharge arc chamber forming wall and not accumulates in the cylinder portion of the discharge arc chamber forming wall. As a result, the emergent light emitted to the lower side of the cylinder portion of the discharge arc chamber forming wall can be utilized effectively.

In other words, the taper portion of the discharge arc chamber forming wall is positioned to not surround the arc but rather to surround the electrode. When the overall discharge arc chamber forming wall is used as the linear light source image, the luminance of the taper portion is lower than the luminance of the cylinder portion of the discharge arc chamber forming wall. Therefore, the emergent light from the taper portion is colored in a same color as the accumulated metal halogenide not to provide a white light distribution. Also, the whole cylinder portion of the discharge arc chamber forming wall, which gives the white arc over the overall arc and has a high intensity can be utilized as a linear light source by blocking the emergent light from the taper portion of the discharge arc chamber forming wall and having a low luminance. As a result, the proper light distribution pattern can be formed and the conversion efficiency into the effective luminous flux is never reduced.

Thus, a discharge bulb according to the exemplary embodiments of the present invention is excellent in the mechanical strength of the ceramic tube and is excellent in the conversion efficiency into the effective luminous flux, and is able to maintain the desired luminous flux for a long term.

Moreover, in the discharge bulb according to the exemplary embodiments of the present invention, the overall cylindrical portion of the discharge arc chamber forming wall is utilized as a light source. Therefore, the proper light distribution pattern can be formed without causing the significant reduction of a conversion efficiency of the effective luminous flux.

Moreover, a discharge bulb according to the exemplary embodiments of the present invention can maintain the desired luminous flux for a long term without fail.

Although particular exemplary embodiments of the present invention have been described, it will be readily evident to those skilled in the art that various changes and modification may be made therein without departing from the present invention. Accordingly, other implementations are within the scope of the claims.

What is claimed is:

1. A discharge bulb comprising:

an arc tube main body comprising:

a discharge arc chamber disposed in a center portion of the arc tube main body in a longitudinal direction, in which two discharge electrodes are disposed to oppose to each other and a luminous material is sealed together with a starting rare gas;

a tube portion disposed at each end portion of the arc tube main body, each of the tube portions being in communication with the discharge arc chamber and holding an inserted respective one of the discharge electrodes, wherein a wall for forming the discharge arc chamber has a taper portion whose diameter is reduced gradually from a cylinder portion of the arc tube main body in a center area in the longitudinal direction to the tube portion of the arc tube main body, the taper portion being connected to a pore of the tube portion, and an inner diameter Di of the cylinder portion is about 1.0 mm≦Di≦about 2.5 mm, and a projection length Le of the discharge electrode into the discharge arc chamber is about 1.5 mm≦Le≦about 2.5 mm.

2. The discharge bulb of claim 1, wherein a top end of each of the discharge electrodes protrudes into the cylinder portion of the wall.

3. The discharge bulb of claim 1, wherein each of the discharge electrodes comprises:

a first rod portion on a top end side of the discharge electrode as an electrode main body, the first rod portion being arranged to protrude from an inner area of the pore of the tube portion into the discharge arc chamber, and a second rod portion on a base end side of the discharge electrode, the second rod portion having a substantially same diameter as the pore and being inserted into the pore integrally with the first rod portion in a coaxial manner, wherein an annular chamber that is formed to surround the first rod portion and that communicates with the discharge arc chamber is formed on an opening portion side of the pore toward the discharge arc chamber, and a length Li of the annular chamber satisfies an expression: about 2.0 mm≦Li+Le≦about 3.0 mm.

4. The discharge bulb of claim 2, wherein the electrode rod comprises:

a first rod portion on a top end side of the electrode rod as an electrode main body, the first rod portion being arranged to protrude from an inner area of the pore of the tube portion into the discharge arc chamber, and a second rod portion on a base end side of the electrode rod, the second rod portion having a substantially same diameter as the pore and being inserted into the pore integrally with the first rod portion in a coaxial manner, wherein an annular chamber that is formed to surround the first rod portion and that communicates with the discharge arc chamber is formed on an opening portion side of the pore toward the discharge arc chamber, and a length Li of the annular chamber satisfies an expression: about 2.0≦Li+Le≦about 3.0 mm.

5. The discharge bulb of claim 1, wherein the arc tube main body is made of ceramic material.

6. The discharge bulb of claim 1, further comprising:

a shroud glass which covers the arc tube main body to shield the arc tube main body from ultraviolet rays; and two lead wires which are electrically coupled to the two discharge electrodes, respectively, and which are pulled out from either end of the arc tube main body.

7. The discharge bulb of claim 1, wherein the luminous material is a metal halogenide.

8. An arc tube comprising:

a discharge arc chamber comprising a center portion having an inner diameter Di, a taper portion at each end in a longitudinal direction of the center portion, and an annular portion at each end of the taper portion in a longitudinal direction, a diameter of the taper portions being gradually reduced in the longitudinal direction from the center portion to the annular portion;

two tube portions, one of the tube portions disposed at each end portion in the longitudinal direction of the taper portion of the discharge arc chamber, each of the tube portions being in communication with the discharge arc chamber; and two electrodes, one of the two electrodes being disposed in each of the tube portions, a portion of each of the two electrodes extending through an interior end portion of the corresponding tube portion and into the discharge arc chamber, wherein the annular portion of the discharge arc chamber comprises a space between the interior end portion of the tube portion and the portion of the electrode extending therethrough, Di satisfies a relationship: about 1.0 mm≦Di≦about 2.5 mm, and a length Le of a portion of each of the two electrodes which extends from an interior side of the annular portion into the discharge arc chamber satisfies a relationship: about 1.5 mm≦Le≦about 2.5 mm.

9. The arc tube of claim 8, wherein each of the two electrodes comprises:

an electrode rod comprising a first portion and a second portion, the first portion comprising the portion of the electrode extending through the interior end portion of the corresponding tube portion and into the discharge arc chamber; and a base end portion disposed coaxially around the second portion of the electrode rod and having an exterior diameter which is less than an inner diameter of the respective tube portion in which the electrode is disposed, wherein an exterior diameter of the electrode rod is less than the exterior diameter of the base end portion, and a length Li of the portion of the electrode rod that extends through the annular portion satisfies an expression: about 2.0 mm≦Li+Le≦about 3.0 mm.

10. A vehicle headlamp comprising:

the discharge bulb of claim 1.

11. The discharge bulb of claim 1, wherein the taper portion comprises a frusto-conical shape.

12. The discharge bulb of claim 1, wherein the inner diameter Di of the cylinder portion is 1.0 mm≦D≦2.5 mm, and the projection length Le of the discharge electrode into the discharge arc chamber is 1.5 mm≦Le≦2.5 mm.

13. The discharge bulb of claim 12, wherein a first rod portion on a top end side of the electrode rod as an electrode main body, the first rod portion being arranged to protrude from an inner area of the pore of the tube portion into the discharge arc chamber, and a second rod portion on a base end side of the electrode rod, the second rod portion having a substantially same diameter as the pore and being inserted into the pore integrally with the first rod portion in a coaxial manner, wherein an annular chamber that is formed to surround the first rod portion and that communicates with the discharge arc chamber is formed on an opening portion side of the pore toward the discharge arc chamber, and a length Li of the portion of the electrode rod that extends through the annular portion satisfies an expression: 2.0 mm≦Li+Le≦3.0 mm.

14. The arc tube of claim 8, wherein the inner diameter Di of the cylinder portion is 1.0 mm≦D≦2.5 mm, and the projection length Le of the discharge electrode into the discharge arc chamber is 1.5 mm≦Le≦2.5 mm.

15. The arc tube of claim 14, wherein a first rod portion on a top end side of the electrode rod as an electrode main body, the first rod portion being arranged to protrude from an inner area of the pore of the tube portion into the discharge arc chamber, and a second rod portion on a base end side of the electrode rod, the second rod portion having a substantially same diameter as the pore and being inserted into the pore integrally with the first rod portion in a coaxial manner, wherein an annular chamber that is formed to surround the first rod portion and that communicates with the discharge arc chamber is formed on an opening portion side of the pore toward the discharge arc chamber, and a length Li of the portion of the electrode rod that extends through the annular portion satisfies an expression: 2.0 mm≦Li+Le≦3.0 mm.

* * * * *